United States Patent [19]

Schink

[11] Patent Number: 4,646,604

[45] Date of Patent: Mar. 3, 1987

[54] MACHINE TOOL, ESPECIALLY A PUNCH

[75] Inventor: Karl Schink, Attendorn-Dunschede, Fed. Rep. of Germany

[73] Assignee: Muhr und Bender, Attendorn, Fed. Rep. of Germany

[21] Appl. No.: 794,785

[22] Filed: Nov. 4, 1985

[30] Foreign Application Priority Data

Nov. 2, 1984 [DE] Fed. Rep. of Germany ..... 3440093

[51] Int. Cl.[4] ..... B30B 9/00

[52] U.S. Cl. ..... 83/698; 83/620; 279/44; 279/89

[58] Field of Search ..... 83/698, 620, 622, 687, 83/691; 279/44, 45, 77, 76, 89

[56] References Cited

U.S. PATENT DOCUMENTS

| | | | |
|---|---|---|---|
| 1,569,136 | 1/1926 | Pardee, Jr. | 279/77 X |
| 1,646,090 | 10/1927 | Hansen | 279/44 X |
| 3,831,483 | 8/1974 | Beauplat | 83/698 |
| 4,176,991 | 12/1979 | Egli | 279/44 X |

FOREIGN PATENT DOCUMENTS

| | | | |
|---|---|---|---|
| 327828 | 4/1930 | United Kingdom | 279/44 |

*Primary Examiner*—James M. Meister

*Attorney, Agent, or Firm*—Browdy and Neimark

[57] ABSTRACT

In a machine tool, especially a punch, having a vertically movable upper tool carrier (1) with at least two punching tools (2) located next to each other and a lower tool carrier (3) with at least two punch matrixes (4) located next to each other, wherein preferably each punching tool (2) consists of a punch (5), a punch holder (6) and a retaining nut (7) connecting the punch (5) with the punch holder (6), and taking into consideration the cramped space in the upper tool carrier (1), a quick change of a punch (5) or of a punching tool (2) and/or of all punches (5) or punching tools (2) is possible, because the upper tool carrier (1) has a receiver plate (8) with a plurality of punch receivers (9) located next to each other and corresponding to the number of punching tools (2), because the punch receivers (9) are open in the direction of the front face of the upper tool carrier (1) and thereby the upper ends of the punching tools (2) or the punch holders (6) of the punching tools (2) are insertable or can be pushed into the punch receivers (9) generally in a horizontal manner, and because a locking cap (10) is provided, which closes all punch receivers (9) at their open ends and is lockable with the receiving plate (8). It is especially advantageous if the locking cap (10) is pivotably connected to the receiving plate (8) and can be locked to the receiving plate (8) by means of a locking device (13).

18 Claims, 5 Drawing Figures

MACHINE TOOL, ESPECIALLY A PUNCH

FIELD OF THE INVENTION

The present invention relates to a machine tool, especially a punch having a vertically movable upper tool carrier with at least two punching tools disposed next to each other, and a lower tool carrier with at least two punching dies disposed next to each other, wherein each punching tool preferably consists of a punch, a punch holder and a retaining nut connecting the punch with the punch holder.

Machine tools of the above described kind are known in various embodiments. The present invention is based on a punch actually known, having three punching tools disposed next to each other at a fixed distance, capable of being operated by the drive carrier in accordance with the desired hole diameter. By means of an accordingly set-up coordinate table,each work piece to be worked on can be positioned in respect to the desired punching tool in such a way that a hole with the desired diameter can be punched at the desired location. In order to keep the work paths of the coordinate table as short as possible, the punching tools are disposed as closely to each other as possible.

If a punching tool or a punch of a punching tool is to be replaced, it is necessary in the known machine tool to remove, while the punch holder remains on the upper tool carrier, the retaining nut connecting the punch with the punch holder, to remove the punch from the punch holder and exchange it for another punch and to replace the retaining nut to connect the punch with the punch holder. This is slow and laborious, especially if the retaining nut has to be loosened and then retightened in the restricted space on the upper tool carrier.

In a more recent punch an upper tool carrier with a single punching tool has been realized from which the punching tool. i.e. punch, punch holder and retaining nut, can be removed with a single motion. The removal of the punch from the punch holder can then be accomplished on the removed punching tool or it is even possible to exchange the punching tool quickly for another punching tool; the exchange of the punch can then take place somewhere else, for instance at a parts depot. In this machine tool with a single punching tool a so-called locking plug is provided for the opening and locking of the tool carrier. This locking plug has a vertical insertion slit through which the punching tool can be inserted or pushed into the punch receiver of the upper tool carrier. The locking plug is fastened pivotably around a vertical axis on the tool carrier, so that the insertion slit can be moved from the front of the upper tool carrier into the inside of the upper tool carrier. By means of the rotation of the locking plug the upper tool carrier can:then be locked.

Although the above explained system having a locking plug permits an exceptionally quick and easy change of punching tools, this system cannot be used in connection with a machine tool having more than one punching tool in the upper tool carrier. The reason for this is that the lateral distances between the punching tools are too small to permit the use of a locking plug for each punching tool.

Furthermore, it should generally be noted that the above explanations are not only valid for machine tools in the form of punches. Even if, for instance, at least two coping tools are disposed next to each other in an upper tool carrier, the above explanations are generally valid. Therefore the teaching of the present invention is not restricted to a punch and to punching tools, but is also applicable in respect to all machine tools having comparable problems. However, the teaching of the present invention is explained here and in the preferred embodiment below in relation to a punch in order to facilitate the understanding of the teaching of the invention.

SUMMARY OF THE INVENTION

Taking into consideration the previously explained state of the art, the teaching of the present invention has as its objective to show how, in a machine tool, especially in a punching tool with two or more punches, it is possible to quickly exchange one and/or all punches, even considering the cramped space in the upper tool carrier.

The machine tool in accordance with the present invention, by means of which the above objective is achieved, is characterized by having in the upper tool carrier a receiving plate with a number of punch receivers corresponding to the number of punching tools and disposed next to each other, the punch receivers being open in the direction of front of the upper tool carrier. Therefore the upper ends of the punching tools or the punch holders of the punching tools can be inserted or pushed into the punch receivers in a generally horizontal direction. A locking cap, capable of being locked together with the receiving plate and locking all punch receivers at their open ends is provided. In accordance with the present invention a punch receiver for each punching tool is provided in the receiving plate, which is open towards the front end of the upper tool carrier. These punch receivers can be located as closely as the structurally required minimal wall thickness will allow. However, these punch receivers are not closed by means of individually pivotable locking plugs known in the art, but by a locking cap acting on all the punch receivers together. The open ends of the punch receivers in the receiving plate are all locked in one step by means of applying the locking cap and locking it with the receiving plate. All punching tools are thereby secured in the punch receivers. In a reversal, all punch receivers are opened when the locking cap is removed from the receiving plate and the punching tools in the punch receivers can be simply pulled out in the direction of the front of the tool carrier.

Using the teaching of the present invention has made it possible to create a system for the quick change of the punching tools or the punches in a machine tool, especially a punch having a vertically movable upper tool carrier with a least two punching tools disposed next to each other, which is not inferior in its effectiveness to the known system used in connection with a machine tool having only a single punching tool and which, at the same time, takes into consideration the restricted space available in the upper tool carrier of a machine tool of the species of the invention.

There are a number of possibilities to construct and further develop a machine tool in accordance with the present invention. The present invention will be better understood and further objects and advantages thereof will become more apparent from the following detailed description of preferred embodiments taken in conjunction with the drawings.

DESCRIPTION OF THE PREFERRED EMBODIMENTS

Figure 1:
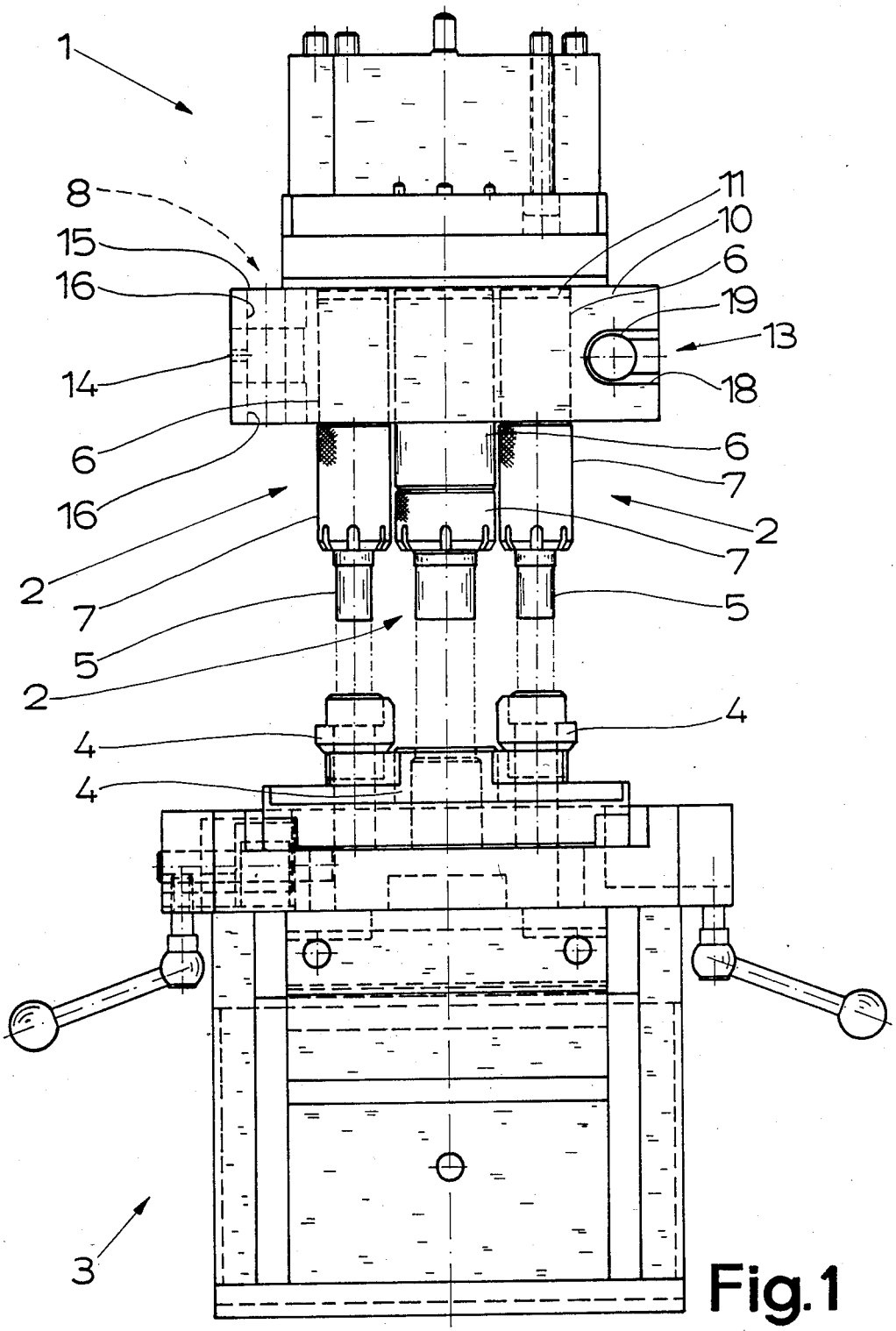
FIG. 1 shows, in schematic form, an exemplary embodiment of a machine tool in accordance with the present invention in a frontal view and partially cut open.

The machine tool shown in schematic form in a frontal view and partially cut open in FIG. 1, in the exemplary embodiment shown as a punch, has a vertically movable upper tool carrier 1 with three punching tools 2 disposed next to each other and a lower tool carrier 3 with three correspondingly disposed punch matrixes 4. The upper tool carrier 1 is of importance in connection with the teaching of the present invention, therefore the lower tool carrier 3 is not further described here. The lower tool carrier 3 in this particular embodiment is the subject of the German Patent Application No. P 34 32 671.5 of applicant.

Figure 2:
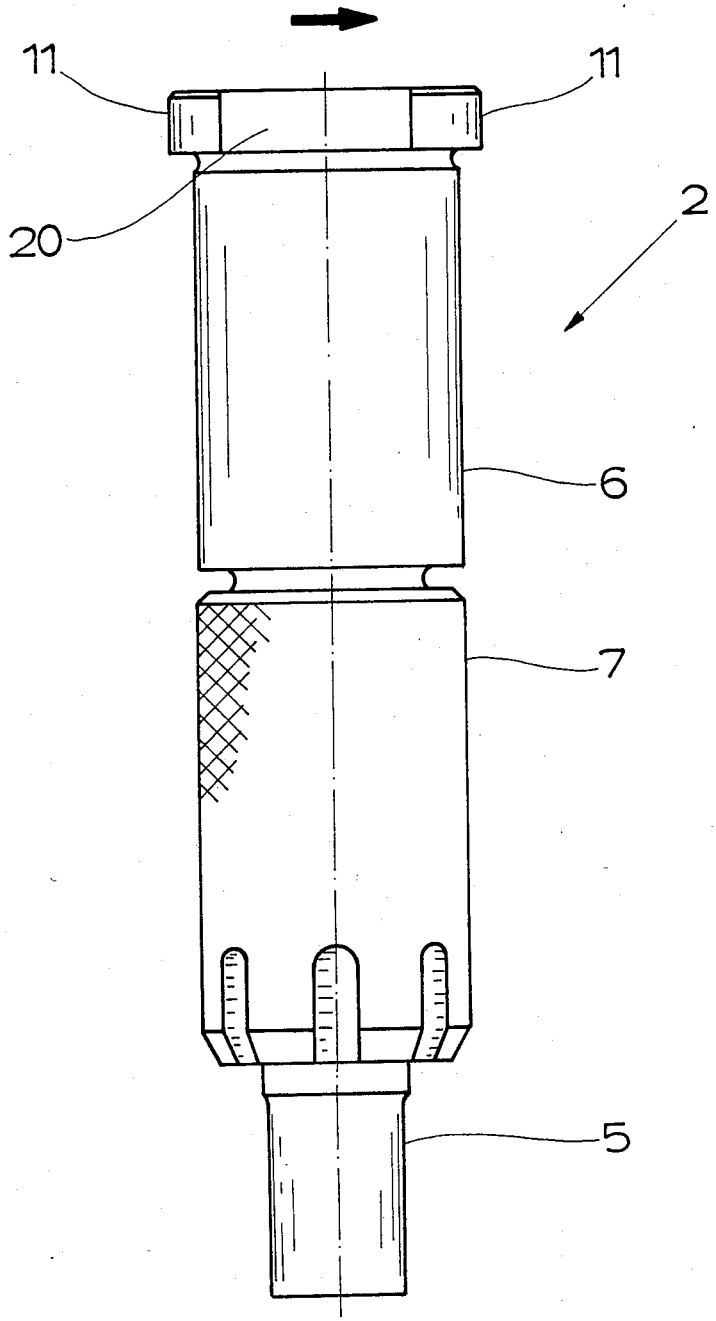
FIG. 2 shows a side view of a punching tool for a machine tool shown in FIG. 1.

As shown by FIG. 1 in connection with FIG. 2, each punching tool 2 of the upper tool carrier 1 in the exemplary embodiment of a machine tool shown consists of a punch 5, a punch holder 6 and a retaining nut 7 connecting the punch 5 with the punch holder 6. The punch 5 can be removed from the punch holder 6 by unscrewing the retaining nut 7.

Figure 4:
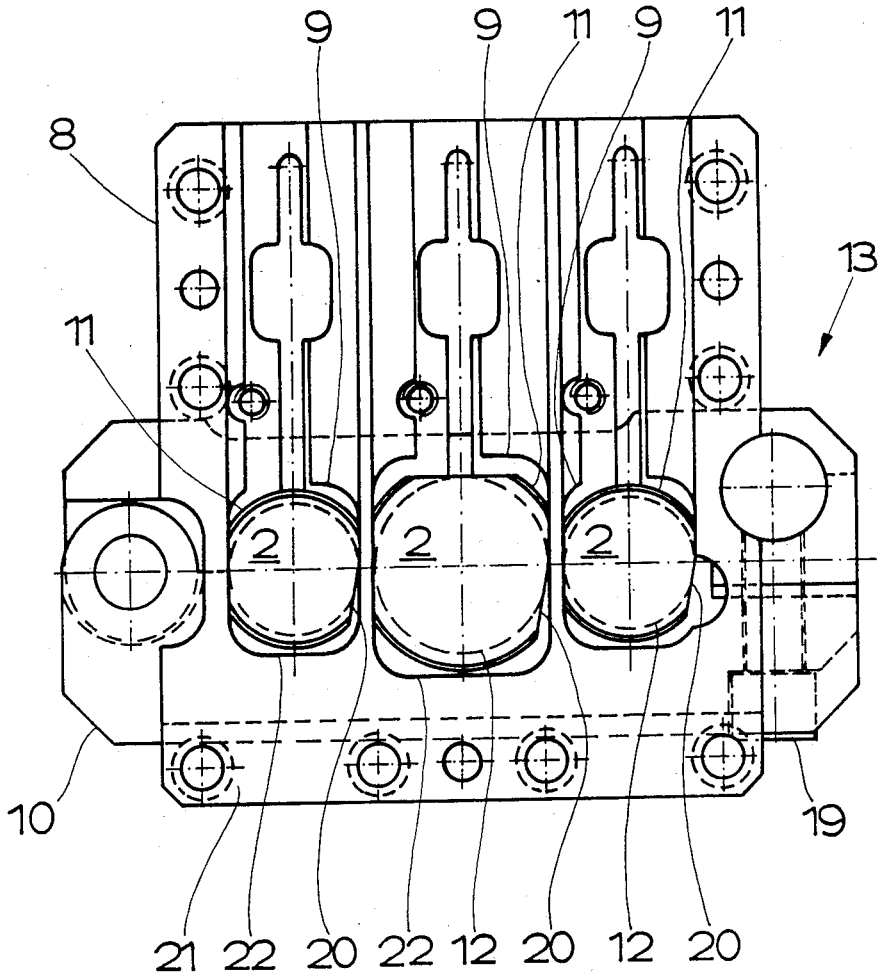
FIG. 4 shows the object of FIG. 3 with punching tools inserted and closed locking cap.
Figure 5:
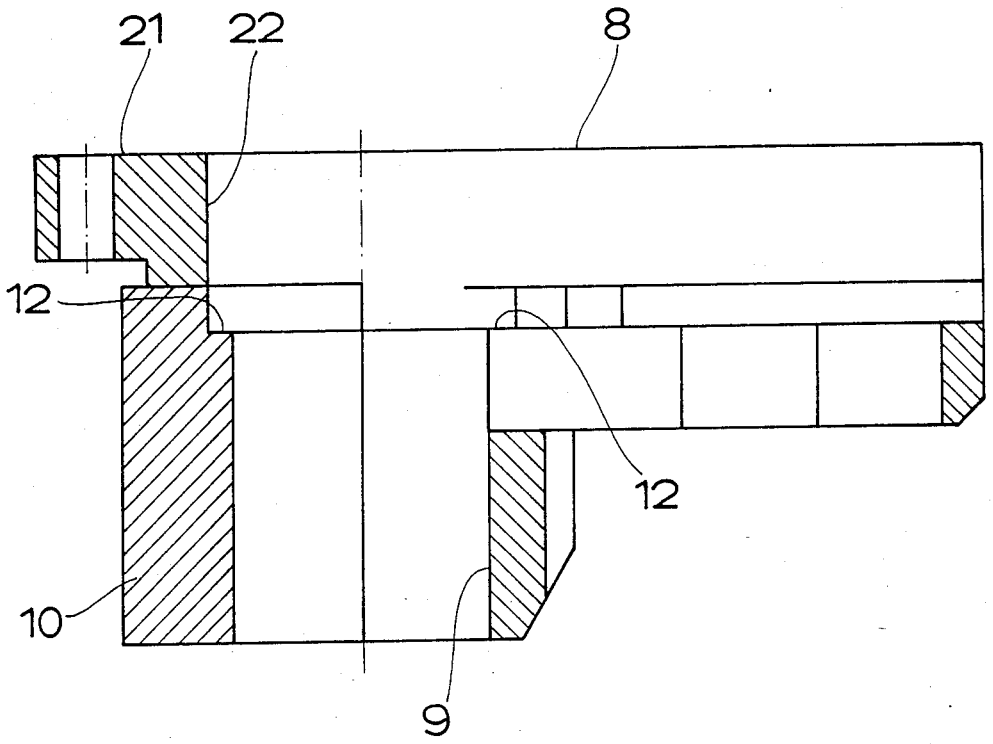
FIG. 5 shows the object of FIG. 4 in a vertical section.

Not shown in FIG. 4 is the device permitting the "activation" of the desired punching tool(s) 2. A system making this possible is shown, for instance, in German Offenlegungschrift DE-OS No. 29 40 661, and reference is made thereto.

FIG. 1 also clearly shows that the three punching tools 2 provided in the machine tool shown have been disposed as closely to each other as possible so that a coordinate table, not shown in FIG. 1, has the shortest possible travel when a work piece, also not shown, is positioned under various punching tools 2.

In the present state of the art from which the instant invention proceeds, the retaining nut 7 must be removed from the punch holder 6 while the latter is fastened to the tool carrier 1 in order to change a punch 5. Obviously this is very laborious and time-consuming, given the restricted space in the upper tool carrier 1. In contrast thereto the punching tools 2 can be removed from the upper tool carrier 1 together in a machine tool of the present invention, i.e. they can be pulled out in the direction of the front end of the upper tool carrier 1. For this purpose the upper tool carrier 1 has a receiving plate 8 with a number of punch receivers 9 corresponding to the number of punching tools 2 and disposed next to each other. This is clearly shown in FIG. 3 in conjunction with FIG. 1.

Figure 3:
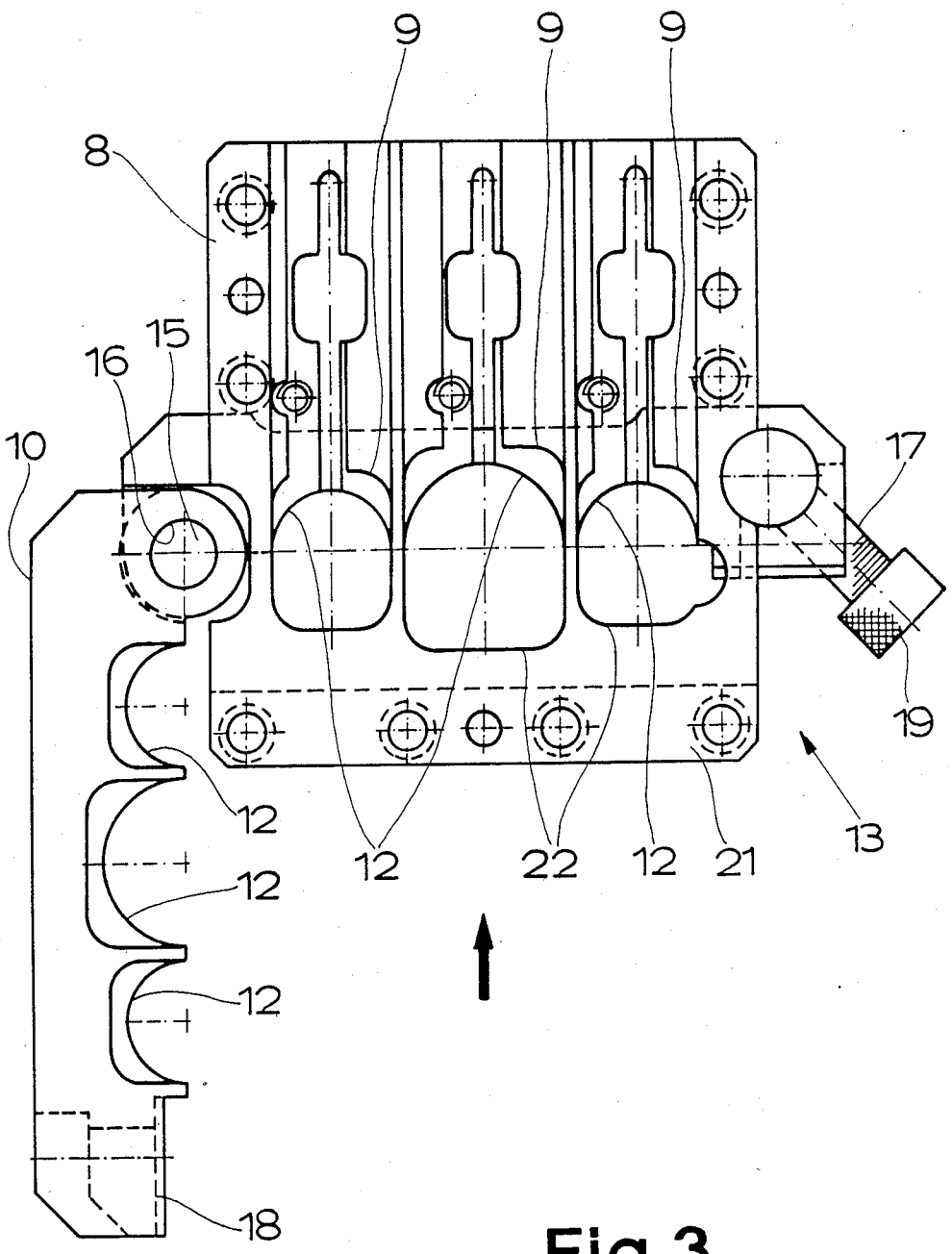
FIG. 3 shows a top view, extremely simplified, of a receiving plate with opened locking cap for a machine tool in accordance with FIG. 1.

The punch receivers 9 in the receiving plate 8 are open in the direction of the front end of the upper tool carrier 1, so that the upper ends of the punching tools 2 or of the punch holders 6 of the punching tools 2 can be inserted or pushed into the punch receivers 9 in a generally horizontal manner. FIG. 3, in conjunction with FIG. 1, further shows that a locking cap 10, which locks all punch receivers 9 at their open ends, is provided and can be locked together with receiving plate 8. By means of this construction in accordance with the present invention all of the punching tools 2 can be pulled quickly and easily in the direction towards the front end of the upper tool carrier 1, out of the punch receivers 9, can be exchanged and can be reinserted or pushed in again. If a punching tool 2 consists of a punch 5, punch holder 6 and retaining nut 7, the loosening of the retaining nut 7 can take place after the punching tool 2 has been removed from the upper tool carrier 1, i.e. where there is sufficient working space. The entire punching tool 2 can also be replaced, in this case the punch 5 can be exchanged for another punch 5 at another place, for instance at a parts depot.

Construction of the punching tools 2 and of the upper tool carrier 1 can be done in different ways. An especially preferred embodiment is shown in FIGS. 1 to 5 taken together. It is especially practical if, as shown in FIG. 2, the upper ends of the punching tools 2 or of the punch holders 6 of the punching tools 2 are provided with hammer head-like expansions 11 and if, as especially clearly shown in FIG. 3, the receiving plate 8 and preferably also the locking cap 10 in the punch receivers 9 are provided with supporting flanges 12 corresponding to the hammer head-like expansions 11. The punch holders 6 of the punching tools 2 rest with their hammer head-like expansions 11 on the cbrresponding supporting flanges 12, so that the punching tools 2 cannot slip downwardly out of the upper tool carrier 1, i.e. out of the punch receivers 9 in the receiving plate 8, at least not while the locking cap 10 is closed. In the present preferred embodiment the punching tools 2 can be lifted upwardly from the support flanges 12; this is a desired function, in this way the not "activated" punching tools 2 can be deflected upwardly if they encounter a work piece.

FIG. 3 in conjunction with FIG. 4 illustrates that in the preferred embodiment shown the expansions 11 and the support flanges 12 are not provided on all sides of the punch holder 6 or the punch receivers 9. In order to dispose the punching tools 2 as closely as possible to each other, the expansions 11 are mainly provided only at the front and back ends, seen in the direction of insertion of the punching tools 2 (arrow in FIGS. 3 and 2), of the upper ends of the punching tools 2 or the punch holders 6 of the punching tools 2 and, accordingly, the support flanges 12 are mainly provided only at the closed ends of the punch receivers 9 in the receiving plate 8 on the one hand and, on the other, on the locking cap 10 closing the punch receivers 9. The wall thicknesses remaining between the punch receivers 10 in the receiving plate 8 are as small as possible consistent with structural necessities, so that the lateral distances between the punching tools 2 are minimal. The advantage of this has been described above.

So far it has only been described that the locking cap 10 is lockable with the receiving plate 8. This is a statement only in connection with the closed state of the locking cap 10. However, for example, the locking cap 10 could be completely removable from the receiving plate 8 for the opening of the punch receivers 9. In accordance with a further teaching of the present invention, which is of special importance, the locking cap 10 is pivotably connected with a side of the receiving plate 8 in the preferred embodiment shown and is lockable with the receiving plate 8 by means of a locking device 13, shown in the preferred embodiment on the opposite side of the receiving plate 8. In FIG. 1 it is clearly shown that the pivotable connection of the locking cap.10 at the side of the receiving plate 8 is accomplished by means of a bearing pin 15, fixedly connected with the receiving plate 8 via a set screw 14, the bearing pin 15 engaging upwardly and downwardly in bearing eyelets 16 of the locking cap 10.

The locking device, shown in the preferred embodiment at the opposite side of the receiving plate 8 consists in the preferred embodiment shown of a locking bolt 17, pivotably connected in the horizontal plane to the receiving plate 8 and of a bolt receiver 18, provided on the locking cap 10 and open on one side towards the side. For the purpose of locking the locking bolt 17 can be pivoted into the bolt receiver 18 and, in the preferred embodiment shown, can be tightened by means of a tightening nut 19. Of course the tightening nut 19 as well as the final construction of the locking device 13 are only shown by way of example. There is, of course, a multitude of possibilities to construct the locking device 13 differently. But the construction of the locking device 13 shown is especially practical from the point of operation. Another useful alternative to the tightening nut 19 would be a locking bolt with an adjusting head subject to the tension of a bolt spring. This makes possible the realization of some kind of a snap closure.

Of course, the locking device 13 previously described in detail can also be realized, in conjunction with the locking cap 10, on both sides of the receiving plate 8, in which case the locking cap 10 could be completely removable from the receiving plate 8.

FIG. 2 in conjunction with FIG. 4 shows another characteristic of the preferred embodiment of a machine tool in accordance with the present invention shown here. It is clearly shown that the expansions 11 at the upper ends of the punching tools 2 or the punch holders 6 of the punching tools 2 are beveled from about the middle towards the open ends of the punch receivers 9 on the sides away from the connecting point with the locking cap 10. The beveling of the expansions 11 becomes necessary if the smallest possible tolerance between the outer dimension of the expansions 11 and the inner dimension of the punch receivers 9 is desired and if the locking cap 10 is pivotably connected to one side of the receiving plate 8. In this case and if the bevels 20 were missing, the locking cap 10 would immediately jam if opened.

For reasons of mechanical strength and of the general visual impression, the exemplary embodiment of a machine tool in accordance with the present invention shown here has been constructed in such a way that the receiving plate 8 has a frame 21, with an overhang towards the front face of the upper.tool carrier 1.and with passages 22 for the upper ends of the punching tools 2 or the punch holders 6 of the punching tools 2. This is especially clearly shown in FIGS. 3 and 5. The locking cap 10 is pivotable underneath the frame 21 against the receiving plate 8 in the exemplary embodiment shown. With the locking cap 10 closed there is a generally smooth front face of the upper tool carrier 1. If the receiving plate 8 and the locking cap 10 are correspondingly dimensioned,vertical guides for the punching tools 2 or the punch holders 6 of the punching tools 2 are the result. By means of these vertical guides the exact desired position of the punching tools 2 is assured.

In the actual operation there is no problem inherent in the fact that in the exemplary embodiment of a machine tool in accordance with the present invention shown here the punching tools 2 or the punch holders 6 of the punching tools 2 are only supported in the front and in the back by the receiving plate 8 or the locking cap 10, since the punching tools 2 only need to be reliably lifted via these positively locking connections. No great forces have to be transmitted through these positively locking connections.

Finally, it should be noted that the drawings show, as a preferred embodiment of a machine tool, a punch with three punching tools. The invention is not limited to a punch, it can, for instance, also be used in a machine tool with two or more coping tools. In fact, the teaching of the present invention is applicable in all cases where several tools are disposed in close proximity, i.e. in restricted spaces, in a tool carrier and where they are to be changed quickly and without problems. It is understood that other variants and embodiments of the present invention are possible within the spirit and scope thereof, the invention being defined by the appended claims.

What is claimed is:

1. A machine tool, especially a punch, having a vertically movable upper tool carrier (1) with at least two punching tools (2) disposed next to each other and with a lower tool carrier (3) with at least two punch matrices (4) disposed next to each other, characterized in that the upper tool carrier (1) has a receiving plate (8) with a plurality of punch receivers (9) disposed next to each other and corresponding to the number of the punching tools (2), in that the punch receivers (9) are open in the direction towards the front end of the upper tool carrier (1) and that therefore the upper ends of the punching tools (2) can, in general, be inserted or pushed into the punch receivers (9) horizontally, and in that a locking cap (10) is provided, which closes all punch receivers (9) at their open ends and which can be locked to the receiving plate (8).

2. A machine tool in accordance with claim 1, characterized in that the upper ends of the punching tools (2) are provided with hammer head-like expansions (11), and in that the receiving plate (8) and preferably also the locking cap (10) in the punch receivers (9) is provided with support flanges (12) corresponding to the hammer head-like expansions (11).

3. A machine tool in accordance with claim 2, characterized in that, looking in the direction of the insertion or push-in of the punching tools (2), tho expansions (11) are mainly only provided at the front and back ends of the upper ends of the punching tools (2) and that, accordingly, the supporting flange (12) is mainly formed only at the closed ends of the punch receivers (9) in the receiving plate (8) on the one hand, and, on the other, at the locking cap (10) which closes the punch receivers (9) at their open ends.

4. A machine tool in accordance with claim 1, characterized in that the locking cap (10) is connected to the receiving plate (8), preferably to the side of the receiving plate (8), in a pivotable manner and is lockable by means of a locking device (13), preferably by means of a locking device (13) disposed on the opposite side, with the receiving plate (8).

5. A machine tool in accordance with claim 2, characterized in that the expansions (11) on the punching tools (2) are beveled from about the center on towards the open ends of the punch receivers (0) on the sides away from the connecting point of the locking cap (10).

6. A machine tool in accordance with claim 4, characterized in that the locking device (13) consists of a locking bolt (17), pivotally connected with the receiving plate (8) in the horizontal plane, and of a bolt receiver (18) provided on the locking cap (10), open on one side, preferably towards the side of the receiving plate (8), and in that the locking bolt (17) can be pivoted in the bolt receiver (18) and can be tightened by means of a tightening nut (19) or the like for the purpose of locking.

7. A machine tool in accordance with claim 1, characterized in that the receiving plate (8) has a frame (21) having an overhang in the direction towards the front end of the upper tool carrier (1) and passages (22) for the upper ends of the punching tools (2).

8. A machine tool in accordance with claim 7, characterized in that the locking cap (10) is attachable or pivotable against the receiving plate (8) underneath the frame (21).

9. A machine tool in accordance with claim 1, characterized in that the receiving plate (8) with the punch receivers (9) together with the locking cap (10), in the closed and locked state, form vertical guides for the punching tools (2).

10. A machine tool, especially a punch, having a vertically movable upper tool carrier (1) with at least two punching tools (2) disposed next to each other and with a lower tool carrier (3) with at least two punch matrices (4) disposed next to each other, wherein each punching tool (2) consists of a punch (5), a punch holder (6) and a retaining nut (7) connecting the punch (5) with the punch holder (6), characterized in that the upper tool carrier (1) has a receiving plate (8) with a plurality of punch receivers (9) disposed next to each other and corresponding to the number of the punching tools (2), in that the punch receivers (9) are open in the direction towards the front end of the upper tool carrier (1) and that therefore the upper ends of the punch holders (6) of the punching tools (2) can, in general, be inserted or pushed into the punch receivers (9) horizontally, and in that a locking cap (10) is provided, which closes all punch receivers (9) at their open ends and which can be locked to the receiving plate (8).

11. A machine tool in accordance with claim 10, characterized in that the upper ends of the punch holders (6) of the punching tools (2) are provided with hammer head-like expansions (11), and in that the receiving plate (8) and preferably also the locking cap (10) in the punch receivers (9) is provided with support flanges (12) corresponding to the hammer head-like expansions (11).

12. A machine tool in accordance with claim 11, characterized in that, looking in the direction of the insertion or push-in of the punching tools (2), the expansions (11) are mainly only provided at the front and back ends of the upper ends of the punch holders (6) of the punching tools (2) and that, accordingly, the supporting flange (12) is mainly formed only at the closed ends of the punch receivers (9) in the receiving plate (8) on the one hand, and, on the other, at the locking cap (10) which closes the punch receivers (9) at their open ends.

13. A machine tool in accordance with claim 10, characterized in that the locking cap (10) is connected to the receiving plate (8), preferably to the side of the receiving plate (8), in a pivotable manner and is lockable by means of a locking device (13), preferably by means of a locking device (13) disposed on the opposite side, with the receiving plate (8).

14. A machine tool in accordance with claim 11, characterized in that the expansions (11) on the punch holders (6) of the punching tools (2) are beveled from about the center on towards the open ends of the punch receivers (9) on the sides away from the connecting point of the locking cap (10).

15. A machine tool in accordance with claim 13, characterized in that the locking device (13) consists of a locking bolt (17), pivotally connected with the receiving plate (8) in the horizontal plane, and of a bolt receiver (18) provided on the locking cap (10), open on one side, preferably towards the side of the receiving plate (8), and in that the locking bolt (17) can be pivoted into the bolt receiver (18) and can be tightened by means of a tightening nut (19) or the like for the purpose of locking.

16. A machine tool in accordance with claim 10, characterized in that the receiving plate (8) has a frame (21) having an overhang in the direction towards the front end of the upper tool carrier (1) and passages (22) for the upper ends of the punch holders of the punching tools (2).

17. A machine tool in accordance with claim 16, characterized in that the locking cap (10) is attachable or pivotable against the receiving plate (8) underneath the frame (21).

18. A machine tool in accordance with claim 10, characterized in that the receiving plate (8) with the punch receivers (9) together with the locking cap (10), in the closed and locked state, form vertical guides for the punch holders (6) of the punching tools (2).

* * * * *